US006521172B2

(12) United States Patent
Grearson et al.

(10) Patent No.: US 6,521,172 B2
(45) Date of Patent: Feb. 18, 2003

(54) TOOL FOR DRILLING/ROUTING OF PRINTED CIRCUIT BOARD MATERIALS

(75) Inventors: Alistair Grearson, West Midlands (GB); John Aucote, Warks (GB)

(73) Assignee: Sandvik AB, Sandviken (SE)

( * ) Notice: Subject to any disclaimer, the term of this patent is extended or adjusted under 35 U.S.C. 154(b) by 53 days.

(21) Appl. No.: 09/486,586

(22) PCT Filed: Sep. 4, 1998

(86) PCT No.: PCT/SE98/01574

§ 371 (c)(1), (2), (4) Date: May 15, 2000

(87) PCT Pub. No.: WO99/13121

PCT Pub. Date: Mar. 18, 1999

(65) Prior Publication Data

US 2002/0031440 A1 Mar. 14, 2002

(30) Foreign Application Priority Data

Sep. 5, 1997 (SE) ..... 9703204

(51) Int. Cl.[7] ..... C22C 32/00
(52) U.S. Cl. ..... 419/18
(58) Field of Search ..... 419/18

(56) References Cited

U.S. PATENT DOCUMENTS

| | | | | |
|---|---|---|---|---|
| 3,994,716 A | | 11/1976 | Huppmann et al. | 75/5 BB |
| 4,093,450 A | | 6/1978 | Doyle et al. | 75/5 AA |
| 4,469,505 A | | 9/1984 | Cheresnowsky et al. | 75/5 BA |
| 4,539,041 A | * | 9/1985 | Figlarz et al. | |
| 4,574,011 A | * | 3/1986 | Bonjour et al. | |
| 5,476,531 A | * | 12/1995 | Timm et al. | 75/240 |
| 5,482,530 A | | 1/1996 | Hohne | 75/230 |
| 5,603,075 A | * | 2/1997 | Stoll et al. | |
| 5,658,678 A | | 8/1997 | Stoll et al. | |
| 5,802,955 A | | 9/1998 | Stoll et al. | |
| 6,015,447 A | | 1/2000 | Gorge et al. | 75/255 |

FOREIGN PATENT DOCUMENTS

| | | | |
|---|---|---|---|
| AT | 268706 | * | 2/1969 |
| DE | 2225896 | * | 12/1972 |
| DE | 27 19 532 | | 11/1977 |
| GB | 622041 | * | 4/1949 |
| GB | 1309634 | * | 3/1973 |
| WO | 9213112 | * | 8/1992 |
| WO | 9218656 | * | 10/1992 |

OTHER PUBLICATIONS

V.A. Tracey et al., "Development of Tungsten Carbide–Cobalt–Ruthenium Cutting Tools for Machining Steels, " vol. 82, No. 1, 1998, XP000574252, pp. 281–292.

B. Zetterlaund, "Cemented Carbide in High Pressure Equipment," *High Pressure Engineering*, vol. 2, 1977, pp. 35–40.

* cited by examiner

*Primary Examiner*—Daniel J. Jenkins
(74) *Attorney, Agent, or Firm*—Burns, Doane, Swecker & Mathis, L.L.P.

(57) ABSTRACT

A dense cemented carbide product is described. The product is manufactured from WC with a grain size between 0.1 and 0.4 ¼ m, fine grain size cobalt and ruthenium powders. The product is used in PCB machining operations where the addition of 10–25% Ru to the binder phase offers up to 25% wear resistant incrases and up to 100% increase in chipping resistance in PCB routing compared to conventional materials (6% cobalt and 0.4 ¼ m grain size).

11 Claims, No Drawings

TOOL FOR DRILLING/ROUTING OF PRINTED CIRCUIT BOARD MATERIALS

The present invention relates to a tool for drilling/routing of printed circuit board materials. By alloying the binder phase with Ru in combination with the use of fine grained Co-powder the properties have been improved.

Cemented carbide containing Ru as binder phase alone or in combination with the conventional Co and/or Ni is known in the art. For example, AT 268706 discloses a hard metal with Ru, Rh, Pd, Os, Ir, Pt and Re alone or in combination as binder phase. U.S. Pat. No. 4,574,011 discloses a hard metal composition for ornamental purposes with a binder phase of Co, Ni and Ru. GB 1309634 discloses a cutting tool with a Ru binder phase. GB 622041 discloses a hard metal composition a Co+Ru binder phase.

The routing of Printed Circuit Board materials requires a wide range of properties from the tool material in order for it to perform successfully. These include a hardness in excess of 2000 HV, a resistance to edge chipping that is best defined by a fracture toughness in excess of 8 $MPam^{1/2}$, a resistance to chemical attack from the resins included in printed circuit boards and a sharp as possible a cutting edge. Some of these requirements conflict, for instance the high hardness tends to mean a reduced edge toughness. The new products for this application can, therefore, require a reduced WC grain size to produce a higher hardness with reduced toughness. However, if this is combined with an increase in cobalt content an increased toughness can be achieved for the same hardness. This also results in a sharper cutting edge, which is required.

The invention is primarily concerned with the addition of ruthenium to submicron grades of cemented carbide. The levels of addition vary between 5 and 35, preferably between 15 and 30, wt-% of the binder content with the best results obtained at about 25 wt-%. For best effects the cobalt used should be of the fine grain size cobalt powder having deagglomerated spherical grains of about 0.4 $\mu$m average grain size and with a narrow grain size distribution. Preferably the cobalt powder is polyol cobalt. The cobalt contents to which this addition can be made should vary from 5–12%, preferably 5–8. The average WC grain size shall be <0.8 $\mu$m, preferably <0.4 $\mu$m. The cemented carbide of the invention is preferably a straight WC+Co grade but it may also contain <5 wt-% gammaphase.

In order to obtain the submicron WC grain size $VC+Cr_3C_2$ is added. Because the Ru also acts as a mild grain growth inhibitor an addition of <0.9 wt % $VC+Cr_3C_2$ is generally satisfactory. Particularly good results are obtained if the $VC/Cr_3C_2$ ratio in wt % is 0.2–0.9, preferably 0.4–0.8, most preferably 0.6–0.7. Preferably sintering is performed using gas pressure sintering also referred to as sinter-HIP.

The invention also relates to the use of a cemented carbide with submicron WC grain size and with a binder phase containing 10–30 wt-% Ru as a tool for drilling/routing of printing circuit board materials.

The present invention further relates to a method of making a cemented carbide body comprising one or more hard constituents and a binder phase based on cobalt, nickel and/or iron by powder metallurgical methods milling, pressing and sintering of powders forming hard constituents and binder phase whereby said binder phase contains 10–30 wt-% Ru. At least part of the binderphase powder consists of non agglomerated particles of spheroidal morphology of about 0.4 $\mu$m average grain size and with a narrow grain size distribution wherein at least 80% of the particles have sizes in the interval x±0.2 x provided that the interval of variation (that is 0.4 x) is not smaller than 0.1 $\mu$m.

The advantages offered by the ruthenium additions are as mentioned a further element of grain growth refinement, an increase in resistance to chemical attack and a strengthening of the binder phase without significantly affecting the edge toughness due to the increase in cobalt content used.

EXAMPLE 1

Cemented carbide PCB-router according to the invention were made with the composition 1.9% Ru, 5.6% Cobalt the remainder WC (0.2 $\mu$m grain size), with about 0.7% ($VC+Cr_3C_2$) grain growth inhibitor. The material had a hardness of 2080 HV and a KIC of 8.75 $MPam^{1/2}$.

For comparison the following PCB routers according to prior art were also made. One was 6% cobalt grade with 0.4 $\mu$m WC with a hardness of 2000-2100 HV and one with the same hardness but with 5% cobalt and 0.5 $\mu$m WC grain size.

The routers were ground to 2.4 mm dia and tested as follows:

Workmaterial: Copper clad 3 mm thick FR4 PCB, stacked three deep

Test 1: 30,000 RPM, 1.2 m/min feedrate, 150 m of cut

Test 2: 42,000 RPM, 2.2 m/min feedrate, 100 m of cut

In test 1 routers according to the invention reached 150 m of cut with 25% less average wear than the prior art routers which used 6% cobalt.

In test 2 routers according to the invention reached 100 metres of cut with acceptable levels of wear.

Routers according to prior art with 5% and 6% cobalt both fractured between 50 and 75 metres.

EXAMPLE 2

2.4 mm dia routers according to the invention were made from cemented carbides with varying ruthenium contents as follows:

Composition 1: 1.0% Ru, 6.3% Co, 0.7 $VC+Cr_3C_2$,0.2 $\mu$m WC

Composition 2: 1.4% Ru, 6.0% Co, 0.7 $VC+Cr_3C_2$,0.2 $\mu$m WC

Composition 3: 1.9% Ru, 5.6% Co, 0.7 $VC+Cr_3C_2$,0.2 $\mu$m WC

The routers were tested as follows:

Workmaterial: Copper clad 3 mm thick FR4 PCB, stacked three deep

Conditions : 30,000 RPM, 1.2 m/min feed rate.

Machining until fracture.

Results:

1.0% Ru variant—205 m (Average of 4 cutters)

1.4% Ru variant—333 m (Average of 5 cutters)

1.9% Ru variant—366 m (Average of 7 cutters)

EXAMPLE 3

Cemented carbide PCB microdrills according to the invention were made with the composition 2.2% Ru, 6.4% Co the remainder WC (0.4 $\mu$m grain size), with about 0.8% ($VC+Cr_3C_2$) grain growth inhibitor. The material had a hardness of 2010 HV and a KIC of 8 $MPam^{1/2}$.

For comparison the following PCB micro drills according to prior art were made using 8% cobalt grade with 0.4 $\mu$m WC with a hardness of 1900 HV.

The microdrills were tested and the wear measured. It was found that the prior art materials exhibited 10-15% less wear resistance and 10–15% less resistance to breakage during an increasing feed rate that started at 15 $\mu$m/rev and increasing towards 70.

What is claimed is:

1. Method of making a cemented carbide body comprising one or more hard constituents and a binder phase by pressing and sintering of powders forming hard constituents and binder phase whereby said binder phase contains 10–30 wt- % Ru wherein at least part of the binder phase powder comprises non agglomerated particles of spheroidal morphology of about 0.4 $\mu$m average grain size and with a narrow grain size distribution wherein at least 80% of the particles have sizes in the interval x±0.2x provided that the interval of variation of 0.4x is not smaller than 0.1 $\mu$m.

2. Cemented carbide comprising 5–12% Co binder phase formed from Co powder having deagglomerated spherical grains with a grain size distribution such that at least 80% of the grains have sizes in the interval x±0.2x, provided that the interval of variation of 0.4x is not smaller than 0.1 $\mu$m, wherein said binder phase contains 10–30 wt. % Ru, and submicron WC.

3. Cemented carbide according to claim 2, wherein the deagglomerated spherical grains have an average grain size of about 0.4 $\mu$m.

4. Cemented carbide according to claim 2, further comprising VC in an amount greater than zero, $Cr_3C_2$ in an amount greater than zero, such that ($VC+Cr_3C_2$) is in an amount greater than zero and less than 0.9 wt. %.

5. Cemented carbide according to claim 4, wherein the ratio of wt. % defined as $VC/Cr_3C_2$ is 0.2–0.9.

6. Method according to claim 1, wherein the powders further comprise VC in an amount greater than zero, $Cr_3C_2$ in an amount greater than zero, such that ($VC+Cr_3C_2$) is in an amount greater than zero and less than 0.9 wt. %.

7. Method according to claim 6, wherein wherein the ratio of wt. % defined as $VC/Cr_3C_2$ is 0.2–0.9.

8. A machining tool comprising cemented carbide with 5–12% Co binder phase formed from Co powder having deagglomerated spherical grains with a grain size distribution such that at least 80% of the grains have sizes in the interval x±0.2x, provided that the interval of variation of 0.4x is not smaller than 0.1 $\mu$m, wherein said binder phase contains 10–30 wt. % Ru, and submicron WC.

9. Machining tool according to claim 8, wherein the deagglomerated spherical grains have an average grain size of about 0.4 $\mu$m.

10. Machining tool according to claim 8, further comprising VC in an amount greater than zero, $Cr_3C_2$ in an amount greater than zero, such that ($VC+Cr_3C_2$) is in an amount greater than zero and less than 0.9 wt. %.

11. Machining tool according to claim 10, wherein the ratio of wt. % defined as $VC/Cr_3C_2$ is 0.2–0.9.

* * * * *